United States Patent [19]

Kellerman

[11] 3,957,196

[45] May 18, 1976

[54] CORNER PAD

[75] Inventor: Jack F. Kellerman, Decatur, Ala.

[73] Assignee: Hoerner Waldorf Corporation, St. Paul, Minn.

[22] Filed: Feb. 19, 1975

[21] Appl. No.: 551,043

[52] U.S. Cl. ..... 229/14 C; 206/326; 206/521

[51] Int. Cl.[2] ..... B65D 25/12

[58] Field of Search ..... 229/14 C; 206/326, 521; 248/345.1

[56] References Cited

UNITED STATES PATENTS

| | | | |
|---|---|---|---|
| 621,983 | 3/1899 | Wade | 229/39 B |
| 2,620,116 | 12/1952 | McDonough | 229/14 C |
| 2,979,248 | 4/1961 | Washington | 229/14 C |
| 3,221,973 | 12/1965 | Kalbrener | 229/14 C |
| 3,245,602 | 4/1966 | Bovard | 229/14 C |
| 3,532,263 | 10/1970 | Ross | 206/521 |
| 3,613,985 | 10/1971 | Goodsite | 206/521 |
| 3,653,496 | 4/1972 | Roberts et al. | 229/14 C |
| 3,708,101 | 1/1973 | McDanield | 206/521 |

FOREIGN PATENTS OR APPLICATIONS

| | | | |
|---|---|---|---|
| 1,058,168 | 2/1967 | United Kingdom | 229/14 C |
| 210,348 | 7/1960 | Austria | 229/14 C |

*Primary Examiner*—William Price
*Assistant Examiner*—Bruce H. Bernstein
*Attorney, Agent, or Firm*—Jerry F. Best

[57] ABSTRACT

A three dimensional corner pad for shipping containers or the like and blank for making same, wherein a sheet of paperboard is folded about a center fold line which has spacer tabs cut on either side thereof and which is folded at right angles so that these tabs extend outwardly from the fold line to space two inner panels away from two outer panels which are formed by reverse folding same sheet and bring them together. The tabs serve to space the inner panels from the outer panels, and to provide rigidity and cushioning strength to the pad.

2 Claims, 5 Drawing Figures

CORNER PAD

BACKGROUND OF THE INVENTION

1. Field of the Invention

This invention relates generally to reinforcing and cushioning structures which are used in the corners of shipping and storage containers to protect the contents thereof from harmful contact with the outside carton. More particularly this relates to a one-piece folded paperboard corner post or corner pad constructions which act as cushioning structures in an assembled container.

2. Description of the Prior Art

Where an article is to be shipped in a container and where it is necessary that the article not come into contact with the surfaces of the container, such as in the shipment of an appliance or other large heavy item, it is commonplace to mount the item on some sort of pallet and surround it with corrugated paperboard, and further to place in the corners of the package between the article and the corners of the outer container some type of corner pad which serves to reinforce the container and to prevent the article from moving against the sides and corners during movement and shipment. Previously, corner posts or corner pads have been made from multiple thicknesses of paperboard folded in a general spiral or in a configuration with scores and cuts allowing panels to be folded into a 90° angle solid structure that it fits in the corner. Triangular corner posts have also been commonly used. These pads must, of necessity, be erected prior to assembly and insertion into the container.

It is desirable that a design be generated which uses less material than the traditional type of corner pad, and one which may be erected and assembled prior to the time at which it is to be inserted into the carton or container and designed so that it will remain in its erected form which would result in the saving of labor at the assembly point.

SUMMARY OF THE INVENTION

Accordingly, it has been found that a sheet of paperboard may be folded about a center axis and fold line which has spacing tabs cut on either side thereof in a generally U-shaped configuration to allow the sections on either side thereof to be folded into a 90° relationship and then double fold lines spaced outwardly on either side of the center fold line to allow a reverse fold to be made and create a double wall thickness three dimensional corner pad wherein the outer walls are spaced from the inner walls by the spacer tabs and by the areas between the spaced fold lines which provide edge strength rigidity and cushioning strength in the final package.

DESCRIPTION OF THE PREFERRED EMBODIMENT

Figure 3:
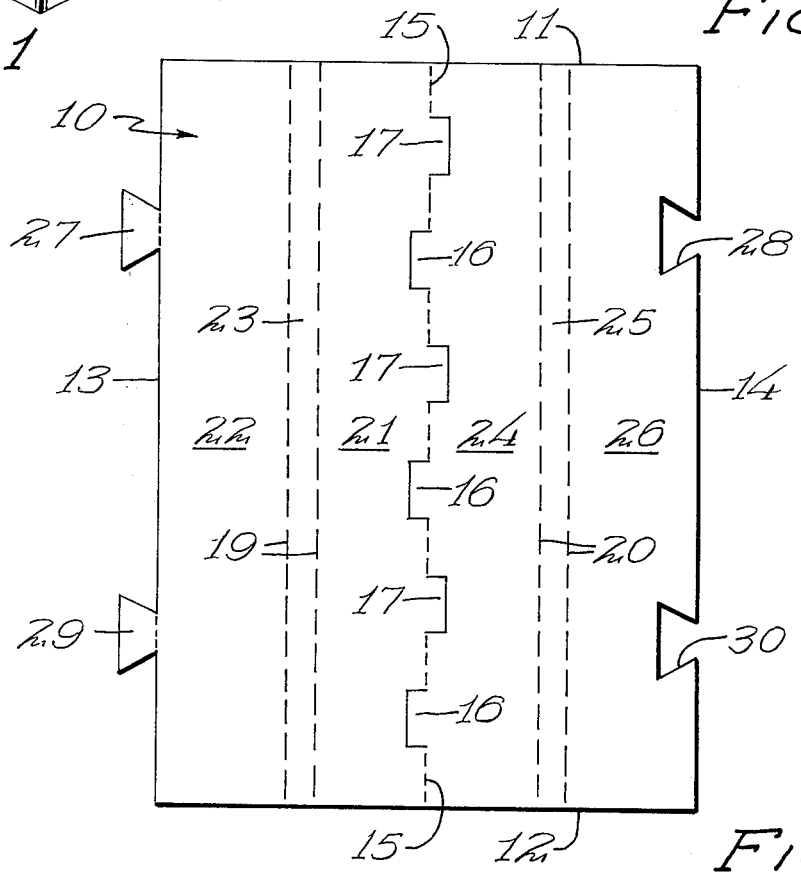
FIG. 3 is a blank shown in plan view adapted to be erected into the pad shown in FIG. 1.

A corner pad is erected from a blank such as that shown in FIG. 3 which is labeled generally as 10 and consists of a substantially rectangular piece of foldable corrugated paperboard or similar sheet-like material which has a top surface edge 11 and a bottom edge 12 with side edges 13 and 14. The blank 10 has a central fold line 15 extending down the middle thereof parallel to the side edges 13 and 14. The center fold line 15 is iterrupted by a series of U-shaped cut lines forming a number of spacer tabs which are shown in the first panel to the left as 16 and 17 on the right pad. Two additional pairs of parallel fold lines are formed on either side of the center fold line and are designated as 19 and 20. These pairs of score lines or fold lines may be formed by any conventional method, and define on each side of the median fold line an inner and an outer pad panel. On the left side the inner pad panel may be seen as 21 and the outer pad panel as 22 separated by the pair of parallel fold lines 19 which define a intermediate panel section 23. On the right hand side of the center fold line is an inner pad panel 24, an intermediate panel 25, and an outer pad panel 26 formed by the fold lines 20.

It can easily be seen in the drawings that the inner pad panels 21 and 24 are foldable into a right angle relationship with one another about the median fold line 15, the alternating intermitant cuts 16 and 17 and score lines 20 permitting the outer pad panel 26 to be reversably folded so that the outer edge 14 is in edge-abutting relationship with the outer edge 13 which has been similarly reverse folded about the pair of score lines 19 and the final configuration is that shown in FIGS. 1, 2, 4 and 5. It can be seen in FIG. 5 that the spacer tabs 16 and 17 extend in two directions and lie in edge abutting relationship with the two outer panels in order to provide more rigidity in the container.

Figure 1:
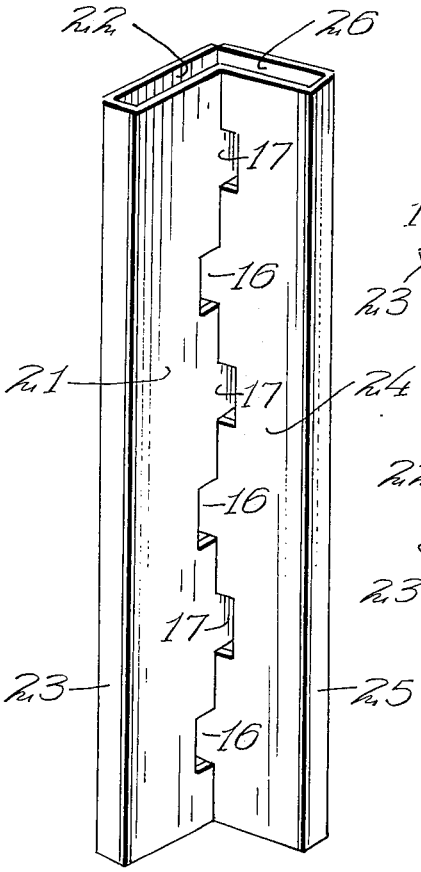
FIG. 1 is a perspective view of a corner pad embodying the present invention showing the surface of the pad which would be oriented toward the center of the container.
Figure 4:
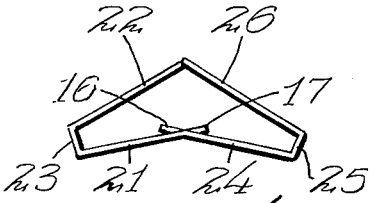
FIG. 4 is a top plan view showing only the edges of the corner pad of FIG. 1 but in a partially folded position.
Figure 5:
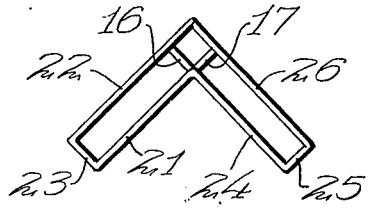
FIG. 5 is a top plan edge view of the pad shown in FIG. 1 in its final folded position.
Figure 2:
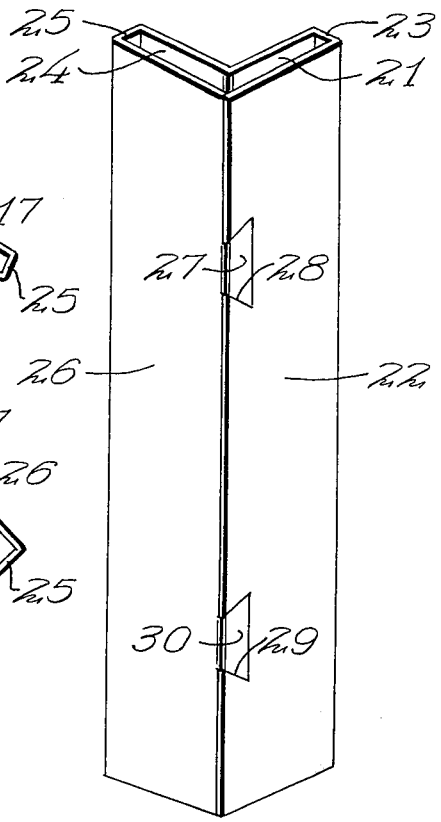
FIG. 2 is a perspective view of the corner pad shown in FIG. 1, but from the opposite side, showing those surfaces which would fit into the corner of the container.

In order to hold the corner pad in erected position after assembly but prior to insertion into the container, locking tabs and insert notches are provided on the opposite edges of the blank and are shown as a trapezoidal shaped tab 27 and a matching trapezoidal shaped notch 28 on the opposite side therefrom, a second similar tab 29 and notch 30 is also provided. The number of tabs and notches depends on the length of the corner post. The trapezoidal shape of the tabs and notches holds them engaged as shown in FIG. 2.

In accordance with the Patent Statutes, I have described the principles of construction and operation of my improvement in CORNER PAD; and while I have endeavored to set forth the best embodiment thereof, I desire to have it understood that obvious changes may be made within the scope of the following claims without departing from the spirit of my invention.

I claim:

1. A blank made from foldable paperboard or similar sheet-like material adapted to be erected into a corner pad for use in cushioning the corners of a container, said blank comprising:

a substantially rectangular sheet of said material having parallel top and bottom edges and opposed parallel lateral edges perpendicular to said top and bottom edges;

a first fold line extending from said top to said bottom edge near the center of said sheet;

said first fold line formed with interruptions, said interruptions comprising spacer tabs defined by three-sided rectangular line cuts extending in both directions away from said first fold line;

said blank having a pair of parallel, closely spaced hinge lines located at equal distances on each side of said first fold line thereby defining a pair of inner pad panels, one on each side of said first fold line;

said pairs of hinge lines arranged vertically and each said pair defining a narrow intermediate panel extending between each of the hinge lines in each of said pairs of hinge lines; and an outer pad panel at each lateral edge of said blank, said outer pad panels defined by the lateral edges of said blank and the respective adjacent pair of hinge lines, said blank thereby having four large panels and two narrow intermediate spacer panels.

2. The blank of claim 1 including means located on each of said outer panels adapted to connect them together when folded into abutting relationship.

* * * * *